US007279443B2

(12) United States Patent
Ishida et al.

(10) Patent No.: US 7,279,443 B2
(45) Date of Patent: Oct. 9, 2007

(54) THERMOGRAPHIC MATERIALS WITH HIGHLY POLYMERIZED BINDER POLYMER

(75) Inventors: Takuzo Ishida, Woodbury, MN (US); David G. Baird, Woodbury, MN (US); Raymond J. Kenney, Woodbury, MN (US)

(73) Assignee: Carestream Health, Inc., Rochester, NY (US)

( * ) Notice: Subject to any disclaimer, the term of this patent is extended or adjusted under 35 U.S.C. 154(b) by 343 days.

(21) Appl. No.: 11/166,398

(22) Filed: Jun. 24, 2005

(65) Prior Publication Data

US 2006/0293184 A1 Dec. 28, 2006

(51) Int. Cl.
*B41M 5/30* (2006.01)

(52) U.S. Cl. ..... 503/201; 503/212; 503/215

(58) Field of Classification Search ..... None
See application file for complete search history.

(56) References Cited

U.S. PATENT DOCUMENTS 6,313,065 B1 11/2001 Horsten et al.

OTHER PUBLICATIONS

JP Abstract 2004-279499.
JP Abstract 2004-279500.

*Primary Examiner*—Bruce H. Hess

(57) ABSTRACT

A direct thermographic material has one or more thermographic layers comprising a film-forming polymer binder on a polymeric support. The binder for at least one thermographic layer comprises a hydrophobic, organic soluble binder that is a polyvinyl acetal having a degree of polymerization greater than 650 and less than 2500.

21 Claims, No Drawings

THERMOGRAPHIC MATERIALS WITH HIGHLY POLYMERIZED BINDER POLYMER

FIELD OF THE INVENTION

This invention relates to non-photosensitive thermographic materials, particularly black-and-white direct thermographic materials, having unique polymer binders to provide increased maximum image density. The invention also relates to methods of imaging such direct thermographic materials.

BACKGROUND OF THE INVENTION

Silver-containing direct thermographic imaging materials are non-photosensitive materials that are used in a recording process wherein images are generated by the direct application of thermal energy and in the absence of a processing solvent. These materials have been known in the art for many years and generally comprise a support having disposed thereon one or more imaging layers comprising (a) a relatively or completely non-photosensitive source of reducible silver ions, (b) a reducing agent composition (acting as a black-and-white silver developer) for the reducible silver ions, and (c) a suitable binder. Thermographic materials are sometimes called "direct thermal" materials in the art because they are directly imaged by a source of thermal energy without any transfer of the image or image-forming materials to another element (such as in thermal dye transfer).

In a typical thermographic construction, the image-forming thermographic layers comprise silver salts of long chain fatty acids. The preferred non-photosensitive reducible silver source is a silver salt of a long chain aliphatic carboxylic acid having from 10 to 30 carbon atoms, such as behenic acid or mixtures of acids of similar molecular weight. At elevated temperatures, the silver(I) of the silver carboxylate is reduced, by a black-and-white reducing agent (also known as a developer) whereby elemental silver is formed. Imagewise heating, such as by using a thermal print-head, results in a black-and-white image.

Problem to be Solved

As noted above, direct thermographic materials are imaged by a recording process whereby images are generated by imagewise heating a recording material containing chemical components that change color or optical density in an imagewise fashion. Such materials generally include one or more thermographic (imaging) layers on a polymeric support. Such thermographic layers generally include the imaging chemistry dispersed in one or more polymer binders. For example, U.S. Pat. No. 6,436,622 (Geisler) describes direct thermographic materials that include an imaging layer containing polyvinyl acetals (such as polyvinyl butyral and polyvinyl formal) as the binder. Various other polymeric materials are also described as potential binders Japanese Kokai 2004-279499 (Onuma et al.) and 2004-279500 (Onuma et al.) describe the use of polyvinyl acetal resins and resin mixtures of various molecular weights in photothermographic materials.

We have found however, that not every hydrophobic binder mentioned in the literature provides the same advantages when imaging direct thermographic materials. For example, we have found that the maximum achievable image density may be reduced when a polyvinyl acetal having a low degree of polymerization is used as the binder in the thermographic layer. One skilled in the art might recover that loss in image density by adding more organic silver salt but this obviously increases the cost of the material and is not an efficient use of silver.

Attempts to achieve a higher image density through either longer contact time with the print-head or by increasing the print-head temperature are often unsuccessful and actually result in a "fall-off" in the maximum image density that can be achieved.

Thus, there is a need to find hydrophobic binders for use in thermographic layers that achieve improved silver efficiency by providing high image density and at the same time use less silver. Such hydrophobic binders also should be capable of providing higher image densities before the initiation of "fall-off."

SUMMARY OF THE INVENTION

This invention provides a non-photosensitive direct thermographic material comprising a support and having thereon one or more thermographic layers, and the material further comprising a non-photosensitive source of reducible silver ions and a reducing agent for the reducible silver ions dispersed in a hydrophobic, organic solvent soluble binder, wherein at least one thermographic layer comprises a hydrophobic, organic soluble binder that is a polyvinyl acetal having a degree of polymerization greater than about 650 and less than about 2500.

This invention also provides a method comprising imaging the direct thermographic material of claim 1 with a thermal imaging source to provide a visible image.

This invention further provides a black-and-white non-photosensitive direct thermographic material comprising a support and having thereon one or more thermographic layers, the material further comprising a non-photosensitive source of reducible silver ions and a reducing agent for the reducible silver ions dispersed in a hydrophobic, organic solvent soluble binder, wherein at least one thermographic layer comprises a hydrophobic, organic soluble binder that is a polyvinyl acetal having a degree of polymerization of about 500 or more and less than about 2500 than has been crosslinked by a polyisocyanate crosslinking agent.

The present invention provides unexpected benefits in silver efficiency, that is, an improvement in the amount of silver that is developed under a given set of thermal exposure and development conditions. In addition, the achievable maximum image density (Dmax) has been increased before fall-off occurs. These advantages have been achieved by the use of a specific hydrophobic binder as the predominant binder in the thermographic material. This binder is a polyvinyl acetal having a degree of polymerization greater than about 650 but less than about 2500.

DETAILED DESCRIPTION OF THE INVENTION

The direct thermographic materials can be used to provide black-and-white silver images using non-photosensitive silver salts, reducing agents, specific binders, and other components known to be useful in such materials.

The direct thermographic materials can be used in black-and-white thermography and in electronically generated black-and-white hardcopy recording. They can be used as output media, in radiographic imaging (for example digital medical imaging), X-ray radiography, and in industrial radiography. Furthermore, the absorbance of these thermographic materials between 350 and 450 nm is desirably low (less than 0.5), to permit their use in the graphic arts area (for example, in imagesetting and phototypesetting operations), in the manufacture of printing plates, in contact printing, in duplicating ("duping"), and in proofing.

The direct thermographic materials are particularly useful as output media for medical imaging of human or animal subjects in response to visible or X-radiation for diagnostic purposes. Such applications include, but are not limited to, thoracic imaging, mammography, dental imaging, orthopedic imaging, general medical radiography, therapeutic radiography, veterinary radiography, and auto-radiography.

In direct thermographic materials, the components needed for imaging can be in one or more thermographic layers on one side ("frontside") of the support. The layer(s) that contain the non-photosensitive source of reducible silver ions, are referred to herein as thermographic, emulsion, or thermally sensitive imaging layer(s).

Where the materials contain thermographic imaging layers on one side of the support only, various non-imaging layers can be disposed on the "backside" (non-emulsion or non-imaging side) of the materials, such as, primer layers, interlayers, opacifying layers, subbing layers, carrier layers, auxiliary layers and/or conductive layers. Particularly important non-imaging layers include a backside conductive layer and an outermost backside protective layer.

In such embodiments, various non-imaging layers can also be disposed on the "frontside," imaging, or emulsion side of the support, including primer layers, interlayers, opacifying layers, subbing layers, auxiliary layers carrier layers, and other layers readily apparent to one skilled in the art.

In some embodiments, the direct thermographic materials are "double-sided" and have thermographic imaging layer(s) on both sides of the support. In such constructions, each side can also include one or more carrier layers, primer layers, adhesive layers, interlayers, antistatic or conductive layers, auxiliary layers, and other layers readily apparent to one skilled in the art. An outermost protective layer can be on either or both sides of the support.

Other aspects, advantages, and benefits of the present invention are apparent from the detailed description, examples, and claims provided in this application.

Definitions

As used herein:

In the descriptions of the thermographic materials, "a" or "an" component refers to "at least one" of that component (for example, the highly polymerized binders described below).

The term "black-and-white" refers to an image formed by silver metal.

"Thermographic material(s)" means a dry processable integral element comprising a support having at least one thermographic emulsion layer or a set of thermographic emulsion layers, (wherein the source of reducible silver ions is in one layer and other components or additives are distributed, as desired, in the same layer or in one or more additional coated layer), that provides a black-and-white silver image. Such additional layers include protective layers, carrier layers, conductive layers, and subbing or priming layers. These materials preferably have at least one outermost protective layer on the imaging side that is in direct contact with the imaging means during thermal imaging. These materials also include multilayer constructions in which one or more imaging components are in different thermographic layers, but are in "reactive association." For example, one layer can include the non-photosensitive source of reducible silver ions and another layer can include the reducing agent, but the two reactive components are in reactive association with each other. Preferably these materials have at least one outermost protective layer as described herein located above all thermographic layers. By "integral," we mean that all imaging chemistry required for imaging is in the material without diffusion of imaging chemistry or reaction products (such as a dye) from or to another element (such as a receiver element).

Also, unless otherwise indicated, the terms "thermographic material" and "direct thermographic material" are meant to refer to embodiments of the present invention.

When used in thermography, the term, "imagewise exposing" or "imagewise exposure" means that the material is imaged using any means that provides an image using heat. This includes, for example, analog exposure where an image is formed by differential contact heating through a mask using a thermal blanket or infrared heat source, as well as by digital exposure where the image is formed one pixel at a time such as by modulation of thermal print-heads or by thermally imaging with a modulated scanning laser beam.

The materials of this invention are "direct" thermographic materials that are imaged using a digital exposure and thermal imaging is carried out in a single thermographic material containing all the necessary imaging chemistry. Direct thermal imaging is distinguishable from what is known in the art as thermal transfer imaging (such as dye transfer imaging) in which the image is produced in one material ("donor") and transferred to another material ("receiver") using thermal means.

"Catalytic proximity" or "reactive association" means that the reactive components are in the same layer or in adjacent layers so that they readily come into contact with each other during thermal imaging and development.

"Emulsion layer," "imaging layer," "thermographic layer," or "thermographic emulsion layer," means a thermally sensitive layer of a thermographic material that contains at least the non-photosensitive source of reducible silver ions. It can also mean a layer of the thermographic material that contains, in addition to the non-photosensitive source of reducible silver, additional desirable components. These layers are usually on what is known as the "frontside" of the support.

The frontside protective layer is the outermost layer on the imaging side of the material that is in direct contact with the imaging means. The backside protective layer is the outermost layer on the side of the support opposite to that containing the imaging layer(s).

"Non-photosensitive" means not intentionally light sensitive. The direct thermographic materials described herein are non-photosensitive meaning that no photosensitive silver halide(s) has been purposely added or created.

"Simultaneous coating" or "wet-on-wet" coating means that when multiple layers are coated, subsequent layers are coated onto the initially coated layer before the initially coated layer is dry.

The sensitometric terms, absorbance, contrast, Dmin, and Dmax have conventional definitions known in the imaging arts. In thermographic materials, Dmin is considered herein as image density in the areas with the minimum application of heat by the thermal print-head. The term Dmax is the maximum transmission image density achieved when the thermographic material is thermally imaged with a given amount of thermal energy. The sensitometric term absorbance is another term for optical density (OD).

"Fall-Off" means that the Dmax as determined by the sensitometric curve of density vs. thermal energy (the D-Log E curve) decreases (that is, "falls off") after reaching a maximum density. A higher maximum density is preferred before fall-off begins.

"Degree of Polymerization" is the number average molecular weight of the polymer divided by the weighted average of the molecular weight of each monomer. The molecular weight of the polymer can be calculated using size exclusion (gel permeation) chromatography. Techniques for such determinations a re well known in the art of polymer chemistry.

Tg is the glass transition temperature and can be determined by Differential Scanning Calorimetry.

Image tone is defined by the known CIELAB color system (Commission Internationale de l'Eclairage) as discussed in detail in *Principles of Color Technology*, $2^{nd}$ Ed., Billmeyer and Saltzman, John Wiley & Sons, 1981. In this color system, color space is defined in terms of L*, a*, and b* wherein L* is a measure of the luminance or lightness of a given color, a* is a measure of the red-green contribution, and b* is a measure of the yellow-blue contribution. In a two-dimension plot of a* versus b*, a more negative a* provides a greener tone and a more negative b* provides a bluer tone. Conversely, a more positive a* provides a more reddish tone and a more positive b* provides a more yellowish tone. Neutral tone is defined wherein a* and b* are both zero. In black-and-white thermography, as optical density increases, a* and b* tend toward zero. Image tone values a* and b* can be measured using conventional methods and equipment, such as a HunterLab UltraScan Colorimeter. In thermographic materials it is preferred to have a "colder" image with a negative a* (green) and a negative b* (blue).

"Transparent" means capable of transmitting visible light or imaging radiation without appreciable scattering or absorption.

The phrases "silver salt" and "organic silver salt" refer to an organic molecule having a bond to a silver atom. Although the compounds so formed are technically silver coordination complexes or silver compounds they are often referred to as silver salts.

The terms "double-sided," "double-faced coating," and "duplitized" are used to define thermographic materials having one or more of the same or different thermographic layers disposed on both sides (frontside and backside) of the support.

"Silver Efficiency" is defined as Dmax divided by the silver coating weight. It is a measure of the amount of silver that has developed under a given set of imaging and development conditions. Samples with a high silver efficiency require less non-photosensitive silver salt to achieve a given image density than those of a comparative sample. Alternatively, silver efficiency can refer to samples achieving a higher image density with the same coating weight of non-photosensitive silver salt.

As is well understood in this art, for the chemical compounds herein described, substitution is not only tolerated, but is often advisable and various substituents are anticipated on the compounds used in the present invention unless otherwise stated. Thus, when a compound is referred to as "having the structure" of a given formula, any substitution that does not alter the bond structure of the formula or the shown atoms within that structure is included within the formula, unless such substitution is specifically excluded by language (such as "free of carboxy-substituted alkyl").

As a means of simplifying the discussion and recitation of certain substituent groups, the term "group" refers to chemical species that may be substituted as well as those that are not so substituted. Thus, the term "alkyl group" is intended to include not only pure hydrocarbon alkyl chains, such as methyl, ethyl, n-propyl, t-butyl, cyclohexyl, iso-octyl, and octadecyl, but also alkyl chains bearing substituents known in the art, such as hydroxyl, alkoxy, phenyl, halogen atoms (F, Cl, Br, and I), cyano, nitro, amino, and carboxy. For example, alkyl group can include ether and thioether groups (for example $CH_3$—$CH_2$—$CH_2$—O—$CH_2$— and $CH_3$—$CH_2$—$CH_2$—S—$CH_2$—), haloalkyl, nitroalkyl, alkylcarboxy, carboxyalkyl, carboxamido, hydroxyalkyl, sulfoalkyl, and other groups readily apparent to one skilled in the art. A skilled artisan would exclude substituents that adversely react with other active ingredients as not being inert or harmless.

*Research Disclosure* (http://www.researchdisclosure.com) is a publication of Kenneth Mason Publications Ltd., The Book Barn, Westbourne, Hampshire PO10 8RS, UK. It is also available from Emsworth Design Inc., 200 Park Avenue South, Room 1101, New York, N.Y. 10003.

Non-Photosensitive Source of Reducible Silver Ions

The non-photosensitive source of reducible silver ions used in the direct thermographic materials can be any silver-organic compound that contains reducible silver(I) ions. Such compounds are generally silver salts of silver coordinating ligands. Preferably, it is an organic silver salt that is comparatively stable to light and forms a silver image when heated to 50° C. or higher in the presence of a reducing agent. Mixtures of the same or different types of silver salts can be used if desired.

Suitable organic silver salts include silver salts of organic compounds having a carboxylic acid group. Examples thereof include silver salts of aliphatic and aromatic carboxylic acids. Silver salts of long-chain aliphatic carboxylic acids are preferred. The chains typically contain 10 to 30, and preferably 15 to 28, carbon atoms. Preferred examples of the silver salts of aliphatic carboxylic acids include silver behenate, silver arachidate, silver stearate, silver oleate, silver laurate, silver caprate, silver myristate, silver palmitate, silver maleate, silver fumarate, silver tartarate, silver furoate, silver linoleate, silver butyrate, silver camphorate, and mixtures thereof. Preferably, silver behenate is used alone or in mixtures with other silver salts.

In some embodiments, a highly crystalline silver behenate can be used as part or all of the non-photosensitive sources of reducible silver ions as described in U.S. Pat. No. 6,096,486 (Emmers et al.) and U.S. Pat. No. 6,159,667 (Emmers et al.), both incorporated herein by reference. Moreover, the silver behenate can be used in its one or more crystallographic phases (such as a mixture of phases I, II and/or III) as described in U.S. Pat. No. 6,677,274 (Geuens et al.) that is incorporated herein by reference.

Other useful but less preferred silver salts include but are not limited to, silver salts of aromatic carboxylic acids and other carboxylic acid group-containing compounds, silver salts of aliphatic carboxylic acids containing a thioether group as described in U.S. Pat. No. 3,330,663 (Weyde et al.), silver carboxylates comprising hydrocarbon chains incorporating ether or thioether linkages, or sterically hindered substitution in the α- (on a hydrocarbon group) or ortho- (on an aromatic group) position, as described in U.S. Pat. No. 5,491,059 (Whitcomb), silver salts of aliphatic, aromatic, or heterocyclic dicarboxylic acids, silver salts of sulfonates as described in U.S. Pat. No. 4,504,575 (Lee), silver salts of sulfosuccinates as described in EP 0 227 141 A1 (Leenders et al.), silver salts of acetylenes as described in U.S. Pat. No. 4,761,361 (Ozaki et al.) and U.S. Pat. No. 4,775,613 (Hirai et al.), silver salts of compounds containing mercapto or thione groups and derivatives thereof (such as those having a heterocyclic nucleus containing 5 or 6 atoms in the ring, at least one of which is a nitrogen atom), as described in U.S. Pat. No. 4,123,274 (Knight et al.) and U.S. Pat. No. 3,785,830 (Sullivan et al.), silver salts of mercapto or thione substituted compounds that do not contain a heterocyclic nucleus, silver salts of compounds containing an imino group (such as silver salts of benzotriazole and substituted derivatives thereof), silver salts of 1,2,4-triazoles or 1-H-tetrazoles as described in U.S. Pat. No. 4,220,709 (deMauriac), and silver salts of imidazole and substituted imidazoles as described in U.S. Pat. No. 4,260,677 (Winslow et al.).

It is also convenient to use silver half soaps that are blends of silver carboxylates and carboxylic acids each having from 10 to 30 carbon atoms.

The methods used for making silver soap emulsions are well known in the art and are disclosed in *Research Disclosure*, April 1983, item 22812, *Research Disclosure*, October 1983, item 23419, U.S. Pat. No. 3,985,565 (Gabrielsen et al.), and the references cited above.

Non-photosensitive sources of reducible silver ions can also be provided as core-shell silver salts such as those described in U.S. Pat. No. 6,355,408 (Whitcomb et al.) or as silver dimer compounds that comprise two different silver salts as described in U.S. Pat. No. 6,472,131 (Whitcomb), both of which are incorporated herein by reference.

Still other useful sources of non-photosensitive reducible silver ions are the silver core-shell compounds comprising a primary core comprising one or more photosensitive silver halides, or one or more non-photosensitive inorganic metal salts or non-silver containing organic salts, and a shell at least partially covering the primary core, wherein the shell comprises one or more non-photosensitive silver salts, each of which silver salts comprises a organic silver coordinating ligand. Such compounds are described in U.S. Pat. No. 6,803,177 (Bokhonov et al.) that is incorporated herein by reference.

The one or more non-photosensitive sources of reducible silver ions are preferably present in an amount of from about 5% to about 70% (more preferably, from about 10% to about 50%), based on the total dry weight of the emulsion layers. Stated another way, the amount of the sources of reducible silver ions is generally present in an amount of from about 0.001 to about 0.2 mol/$m^2$ of the thermographic material, and preferably from about 0.006 to about 0.012 mol/$m^2$ of that material.

Reducing Agents

The thermographic materials include one or more reducing agents (of the same or different types) to reduce the silver ions during imaging. Such reducing agents are well known to those skilled in the art and include, for example, aromatic di- and tri-hydroxy compounds having at least two hydroxy groups in ortho- or para-relationship on the same aromatic nucleus such as hydroquinone and substituted hydroquinones, catechols, pyrogallol, gallic acid and gallic acid esters (for example, methyl gallate, ethyl gallate, propyl gallate), and tannic acid.

Particularly preferred are catechol-type reducing agents having no more than two hydroxy groups in an ortho-relationship.

One particularly preferred class of catechol-type reducing agents are benzene compounds in which the benzene nucleus is substituted by no more than two hydroxy groups which are present in 2,3-position on the nucleus and have in the 1-position of the nucleus a substituent linked to the nucleus by means of a carbonyl group. Compounds of this type include 2,3-dihydroxy-benzoic acid, and 2,3-dihydroxy-benzoic acid esters (such as methyl 2,3-dihydroxy-benzoate, and ethyl 2,3-dihydroxy-benzoate).

Another particularly preferred class of catechol-type reducing agents are benzene compounds in which the benzene nucleus is substituted by no more than two hydroxy groups which are present in 3,4-position on the nucleus and have in the 1-position of the nucleus a substituent linked to the nucleus by means of a carbonyl group. Compounds of this type include, for example, 3,4-dihydroxy-benzoic acid, 3-(3,4-dihydroxy-phenyl)-propionic acid, 3,4-dihydroxy-benzoic acid esters (such as methyl 3,4-dihydroxy-benzoate, and ethyl 3,4-dihydroxy-benzoate), 3,4-dihydroxy-benzaldehyde, and phenyl-(3,4-dihydroxyphenyl)ketone. 3,4-Dihydroxybenzonitrile is also useful. Such compounds are described, for example, in U.S. Pat. No. 5,582,953 (Uytendaele et al.) that is incorporated herein by reference.

Mixtures of catechol reducing agents with various substituents can be used to optimize reactivity, Dmax, Dmin, and other imaging properties of the thermographic material.

Still another particularly useful class of reducing agents are the polyhydroxy spiro-bis-indane compounds that are described in U.S. Pat. No. 3,440,049 (Moede) and U.S. Pat. No. 5,817,598 (Defieuw et al.), both incorporated herein by reference.

In some constructions, "hindered phenol reducing agents" can be used. "Hindered phenol reducing agents" are compounds that contain only one hydroxy group on a given phenyl ring and have at least one additional substituent located ortho to the hydroxy group.

One type of hindered phenol includes hindered phenols and hindered naphthols.

Another type of hindered phenol reducing agents are hindered bis-phenols. These compounds contain more than one hydroxy group each of which is located on a different phenyl ring. This type of hindered phenol includes, for example, binaphthols (that is dihydroxybinaphthyls), biphenols (that is dihydroxybiphenyls), bis(hydroxynaphthyl) methanes, bis(hydroxyphenyl)-methanes bis(hydroxyphenyl)ethers, bis(hydroxyphenyl)sulfones, and bis (hydroxyphenyl)thioethers, each of which may have additional substituents.

Preferred hindered phenol reducing agents are bis(hydroxyphenyl)-methanes such as, bis(2-hydroxy-3-t-butyl-5-methylphenyl)methane (CAO-5), 1,1'-bis(2-hydroxy-3,5-dimethylphenyl)-3,5,5-trimethylhexane (NONOX® or PERMANAX® WSO), and 1,1'-bis(2-hydroxy-3,5-dimethylphenyl)isobutane (LOWINOX® 22IB46). Mixtures of hindered phenol reducing agents can be used if desired.

Further reducing agents include certain ortho-amino-phenol, para-amino-phenol, and hydroquinone (that is, para-hydroxy-phenol) compounds described in copending and commonly assigned U.S. Ser. No. 11/012,788 (filed Dec. 15, 2004 by Whitcomb, Olson, Cowdery-Corvan, Sakizadeh, and Ishida) that is incorporated herein by reference.

The reducing agent (or mixture thereof) described herein is generally present in an amount greater than 0.1 mole per mole of silver and at 1 to 10% (dry weight) of the emulsion layer. In multilayer constructions, if the reducing agent is added to a layer other than an emulsion layer, slightly higher proportions, of from about 2 to 15 weight % may be more desirable. Any co-developers may be present generally in an amount of from about 0.001% to about 1.5% (dry weight) of the emulsion layer coating.

Stated another way, the reducing agents described herein can be present in an amount of at least 0.03 mol/mol of total silver. Preferably, they are present in an amount of from about 0.05 to about 2 mol/mol of total silver. The total amount of silver in the thermographic materials is at least 3 $mmol/m^2$ and preferably from about 6 to about 12 $mmol/m^2$.

Other Addenda

The direct thermographic materials can also contain other additives such as toners, shelf-life stabilizers, contrast enhancers, dyes or pigments, post-processing stabilizers or stabilizer precursors, thermal solvents (also known as melt formers), and other image-modifying agents as would be readily apparent to one skilled in the art.

Suitable stabilizers that can be used alone or in combination include thiazolium salts as described in U.S. Pat. No. 2,131,038 (Staud) and U.S. Pat. No. 2,694,716 (Allen), azaindenes as described in U.S. Pat. No. 2,886,437 (Piper), triazaindolizines as described in U.S. Pat. No. 2,444,605 (Heimbach), the urazoles described in U.S. Pat. No. 3,287,135 (Anderson), sulfocatechols as described in U.S. Pat. No. 3,235,652 (Kennard), the oximes described in GB 623,448 (Carrol et al.), polyvalent metal salts as described in U.S. Pat. No. 2,839,405 (Jones), thiuronium salts as described in U.S. Pat. No. 3,220,839 (Herz), palladium, platinum, and gold salts as described in U.S. Pat. No. 2,566,263 (Trirelli) and U.S. Pat. No. 2,597,915 (Damshroder), compounds having —$SO_2CBr_3$ groups as described in U.S. Pat. No. 5,369,000 (Sakizadeh et al.), U.S. Pat. No. 5,464,747 (Sakizadeh et al.), U.S. Pat. No. 5,594,143 (Kirk et al.) U.S. Pat. No. 5,374,514 (Kirk et al.), and U.S. Pat. No. 5,460,938 (Kirk et al.).

Stabilizer precursor compounds capable of releasing stabilizers upon application of heat during imaging can also be used, as described in U.S. Pat. No. 5,158,866 (Simpson et al.), U.S. Pat. No. 5,175,081 (Krepski et al.), U.S. Pat. No. 5,298,390 (Sakizadeh et al.), and U.S. Pat. No. 5,300,420 (Kenney et al.).

In addition, certain substituted-sulfonyl derivatives of benzotriazoles may be used as stabilizing compounds as described in triazoles U.S. Pat. No. 6,171,767 (Kong et al.).

"Toners" or derivatives thereof that improve the image are desirable components of the thermographic materials. These compounds, when added to the imaging layer, shift the color of the image from yellowish-orange to brown-black or blue-black. Generally, one or more toners described herein are present in an amount of from about 0.01% to about 10% (more preferably from about 0.1% to about 10%), based on the total dry weight of the layer in which the toner is included. Toners may be incorporated in the thermographic emulsion layer or in an adjacent non-imaging layer.

Compounds useful as toners are described in U.S. Pat. No. 3,074,809 (Owen), U.S. Pat. No. 3,080,254 (Grant, Jr.), U.S. Pat. No. 3,446,648 (Workman), U.S. Pat. No. 3,844,797 Willems et al.), U.S. Pat. No. 3,847,612 (Winslow), U.S. Pat. No. 3,951,660 (Hagemann et al.), U.S. Pat. No. 4,082,901 (Laridon et al.), U.S. Pat. No. 4,123,282 (Winslow), and U.S. Pat. No. 5,599,647 (Defieuw et al.) and GB 1,439,478 (AGFA).

Additional useful toners are substituted and unsubstituted mercaptotriazoles as described in U.S. Pat. No. 3,832,186 (Masuda et al.), U.S. Pat. No. 5,149,620 (Simpson et al.), U.S. Pat. No. 6,165,704 (Miyake et al.), U.S. Pat. No. 6,713,240 (Lynch et al.), and U.S. Pat. No. 6,841,343 (Lynch et al.), all of which are incorporated herein by reference.

Phthalazine and phthalazine derivatives [such as those described in U.S. Pat. No. 6,146,822 (Asanuma et al.), incorporated herein by reference], phthalazinone, and phthalazinone derivatives are particularly useful toners.

A combination of one or more hydroxyphthalic acids and one or more phthalazinone compounds can be included in the thermographic materials. Hydroxyphthalic acid compounds have a single hydroxy substituent that is in the meta position to at least one of the carboxy groups. Preferably, these compounds have a hydroxy group in the 4-position and carboxy groups in the 1- and 2-positions. The hydroxyphthalic acids can be further substituted in other positions of the benzene ring as long as the substituents do not adversely affect their intended effects in the thermographic material. Mixtures of hydroxyphthalic acids can be used if desired.

Useful phthalazinone compounds are those having sufficient solubility to completely dissolve in the formulation from which they are coated. Preferred phthalazinone compounds include 6,7-dimethoxy-1-(2H)-phthalazinone, 4-(4-pentylphenyl)-1-(2H)-phthalazinone, and 4-(4-cyclohexylphenyl)-1-(2H)-phthalazinone. Mixtures of such phthalazinone compounds can be used if desired.

This combination facilitates obtaining a stable bluish-black image after processing. In preferred embodiments, the molar ratio of phthalazinone to hydroxyphthalic acid is from about 1:1 to about 3:1. More preferably the ratio is from about 2:1 to about 3:1.

The direct thermographic materials may also include one or more thermal solvents (or melt formers). Combinations of these compounds can also be used, such as a combination of succinimide and dimethylurea. Known thermal solvents are disclosed in U.S. Pat. No. 3,438,776 (Yudelson), U.S. Pat. No. 5,250,386 (Aono et al.), U.S. Pat. No. 5,368,979 (Freedman et al.), U.S. Pat. No. 5,716,772 (Taguchi et al.), and U.S. Pat. No. 6,013,420 (Windender).

The thermographic materials can also include one or more image stabilizing compounds that are usually incorporated in a "backside" layer. Such compounds can include phthalazinone and its derivatives, pyridazine and its derivatives, benzoxazine and benzoxazine derivatives, benzothiazine-dione and its derivatives, and quinazoline-dione and its derivatives, particularly as described in U.S. Pat. No. 6,599,685 (Kong). Other useful backside image stabilizers include anthracene compounds, coumarin compounds, benzophenone compounds, benzotriazole compounds, naphthalic acid imide compounds, pyrazoline compounds, or compounds described in U.S. Pat. No. 6,465,162 (Kong et al.) and GB 1,565,043 (Fuji Photo).

The thermographic materials may also include one or more additional polycarboxylic acids (other than the hydroxyphthalic acids noted above) and/or anhydrides thereof that are in thermal working relationship with the sources of reducible silver ions in the one or more thermographic layers. Such polycarboxylic acids can be substituted or unsubstituted aliphatic (such as glutaric acid and adipic acid) or aromatic compounds and can be present in an amount of at least 5 mol % ratio to silver. They can be used in anhydride or partially esterified form as long as two free carboxylic acids remain in the molecule. Useful polycarboxylic acids are described for example in U.S. Pat. No. 6,096,486 (noted above).

Binders

The non-photosensitive source(s) of reducible silver ions, the reducing agent(s), toners, and any other thermographic layer additives are generally combined with one or more polyvinyl acetal binders that are generally hydrophobic in nature. Thus, organic solvent-based formulations can be used to prepare the thermographic materials.

The polyvinyl acetals are the predominant binders in the thermographic layers, meaning that they comprise at least 50 weight %, and preferably greater than 90 weight % of the total binder weight. Polyvinyl acetal is the generic name for the class of polymers formed by the reaction of polyvinyl alcohol with one or more aldehydes. Typically the aldehyde is formaldehyde or an aliphatic aldehyde having 2 to 4 carbon atoms. Acetaldehyde and butyraldehyde are commonly used aldehydes and form polyvinyl acetal (the specific polymer) and polyvinyl butyral respectively. Polyvinyl acetal is also the name for the specific member of this class formed by reaction of polyvinyl alcohol and acetaldehyde. Preferably the polyvinyl acetal is polyvinyl butyral, polyvinyl acetal, or mixtures thereof.

The useful polyvinyl acetals have a degree of polymerization greater than about 650 and less than 2500, and preferably of from greater than about 800 to about 2500. Particularly useful polyvinyl acetals having these characteristics are commercially available from Sekisui Chemical Company as S-LEC® BM, BH, BX and KS resins.

Additional ("secondary") hydrophobic binders can be used in the thermographic layers if desired. Examples of typical secondary hydrophobic binders include low molecular weight polyvinyl acetal resins, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers, and other materials readily apparent to one skilled in the art. Copolymers (including terpolymers) are also included in the definition of polymers.

As noted above, one problem encountered in direct thermal imaging is that the maximum achievable image density appears to be a function of the hydrophobic polymer binder used. Attempts to achieve a higher image density through either longer contact time with the print-head or by increasing the print-head temperature actually result in a "fall-off" in image density. The use of polyvinyl acetal binders having a degree of polymerization greater than about 650 and less than 2500 increases the maximum achievable image density before fall-off begins and therefore allows a higher Dmax to be achieved.

In addition, the use polyvinyl acetal binders having a degree of polymerization greater than about 650 permits less non-photosensitive silver salt to be used to achieve a given image density. This increase in silver efficiency allows the manufacture of direct thermographic materials with lower silver coating weights and lowers manufacturing costs.

We have also found an improvement in the tone of imaged thermographic materials by formulating the thermographic imaging layer in a polymeric binder having a glass transition temperature (Tg) greater than about 87° C., preferably greater than about 100° C., and more preferably equal to or greater than about 106° C.

Hardeners for various binders may be present in any layer of the thermographic material if desired, including the thermographic layers. Useful hardeners including crosslinking agents, are well known and include polyisocyanate compounds as described in EP 0 600 586 B1 (Philip, Jr. et al.) and U.S. Pat. No. 6,313,065 (Horsten et al.), vinyl sulfone compounds as described in U.S. Pat. No. 6,143,487 (Philip, Jr. et al.) and EP 0 640 589 A1 (Gathmann et al.), aldehydes and various other hardeners as described in U.S. Pat. No. 6,190,822 (Dickerson et al.).

The use of polyisocyanates to crosslink the polyvinyl acetal binder permits the use of lower polymerized polyvinyl acetal binders in the thermographic emulsion layers. When such crosslinking agents are used, a polyvinyl acetal having a degree polymerization of about 500 or more can be used. Preferred isocyanates are those described below as crosslinkers for the non-light-sensitive adhesive layer. Aromatic polyisocyanates are more preferred.

The non-imaging layers of the thermographic materials can also include one or more of the same or different hydrophobic binders as described above for the imaging layer. Binders particularly useful for various backside layers and frontside overcoats are described below.

The polymer binder(s) is used in the thermographic layer an amount sufficient to carry the components dispersed therein. Preferably, the total binders comprises from about 10% to about 90% by weight (more preferably at a level of from about 20% to about 70% by weight) of the total dry weight of the layer.

Support Materials

The direct thermographic materials comprise a polymeric support that is preferably a flexible, transparent film that has any desired thickness and is composed of one or more polymeric materials, depending upon their use. The supports are generally transparent (especially if the material is used as a photomask) or at least translucent, but in some instances, opaque supports may be useful. They are required to exhibit dimensional stability during thermal imaging and development and to have suitable adhesive properties with overlying layers. Useful polymeric materials for making such supports include polyesters, cellulose acetate and other cellulose esters, polyvinyl acetal, polyolefins, polycarbonates, and polystyrenes. Preferred supports are composed of polyesters such as polyethylene terephthalate film or polycarbonates.

Opaque supports can also be used, such as dyed polymeric films and resin-coated papers that are stable to high temperatures. Support materials can contain various colorants, pigments, and dyes if desired. For example, the support can contain conventional blue dyes that differ in absorbance from colorants in the various frontside or backside layers as described in U.S. Pat. No. 6,248,442 (Van Achere et al.). Support materials may be treated using conventional procedures (such as corona discharge) to improve adhesion of overlying layers, or subbing or other adhesion-promoting layers can be used.

The support thickness can be within the range of from about 2 to about 15 μm. Preferably, the support thickness is from about 4 to about 10 μm.

Protective Layer

The direct thermographic materials may have at least one non-thermally sensitive protective layer. Such layers can also be known as a "topcoat" or an "overcoat layer." on at least the imaging side of the support. Preferably, this protective layer is the outermost layer on the imaging side. A wide variety of materials are useful as binders or other components in such outermost protective layers as described in U.S. Pat. No. 5,536,696 (Horsten et al.), U.S. Pat. No. 5,817,598 (Defieuw et al.), and U.S. Pat. No. 6,313,065 (noted above). Such protective layers can include matte agents (organic or inorganic particles), "slip" agents, lubricants, pigments, "thermomeltable" particles, reinforcing agents, antistatic agents, conductive agents, coating aids, and tinting agents. It is particularly desired that the outermost protective layer have a dynamic coefficient of friction of less than 0.3 when the thermographic material is moved in contact and relative to an imaging means such as a thermal print-head. This "slip" property is usually provided by incorporating one or more lubricants into the outermost protective layer. The protective layer can include mixtures of lubricants such as one or more solid lubricants and one or more liquid lubricants.

In some embodiments, the thermographic materials comprise an outermost protective layer on the imaging side that comprises two or more specific lubricants from designated classes of compounds. The protective layer provides both protective and transport (or "slip") properties. Useful protective layers and their methods of preparation are described in copending and commonly assigned U.S. Ser. No. 10/767,757 (filed Jan. 28, 2004 by Kenney, Foster, and Johnson) incorporated herein by reference.

More particularly, the protective layer can comprise one or more lubricants from one or more of the following categories of compounds:

(a) solid polymers, each derived from one or more olefins and from one or more ethylenically unsaturated polymerizable carboxylic acids or esters or anhydrides thereof, (b) branched α-olefin polymers, (c) additional waxes other than compounds in categories of (a) and (b), and (d) silicone oils.

Category (a) includes solid polymers derived from one or more olefins and from one or more ethylenically unsaturated polymerizable carboxylic acids or ester or anhydrides thereof. Suitable polymers include those described in U.S. Pat. No. 3,590,076 (Heintzelman et al.) that is incorporated herein by reference in its entirety. The number average molecular weight of the solid polymer is generally from about 300 to about 5000. Mixtures of these solid polymers can be used.

For example, a category (a) polymer includes maleic anhydride polyethylene, maleic acid anhydride polypropylene, iso-propylmaleate polyethylene, and iso-propylmaleate polypropylene graft copolymers.

Category (b) lubricants are branched α-olefin polymers or mixtures thereof. The branched hydrocarbon typically has a number average molecular weight (as measured by vapor pressure osmometry) of at least 300, preferably at least 400, and more preferably at least 500. It typically has a number average molecular weight of no more than 10,000, preferably no more than 5,000, and more preferably no more than 3,000, although the molecular weight can be outside of these ranges. The branched hydrocarbon typically has a melting point (for crystalline materials) or a softening point (for amorphous or semi-crystalline materials) of at least 30° C., preferably at least 35° C., and more preferably at least 50° C., and typically has a melting point or softening point of no more than 120° C., although the melting point can be outside of these ranges. The branched hydrocarbon can be saturated or unsaturated, and can include cyclic moieties. In addition, oxidized hydrocarbons, such as polyethylene-based oxidized materials and microcrystalline-based oxidized materials can be used, as can unsaturated and branched hydrocarbon-like molecules using as a core cyclic compounds or dendrimer or arborols.

Some polymerized α-olefins are commercially available for example, from the Baker Petrolite Corporation (Sugar Land, Tex.) under the tradename VYBAR®, that is available as a solid (for example VYBAR® 103, VYBAR® 260) or liquid (for example VYBAR® 825).

Examples of suitable branched hydrocarbons include VYBAR® 253, a poly(α-olefin) having a number average molecular weight of about 520, a softening point of about 67° C. (measured by ASTM method D36) and a degree of branching of from about 5 to about 10. Also suitable for use are VYBAR® 103 having a number average molecular weight of about 4400, VYBAR® 260 having a number average molecular weight of about 2,600, and the VYBAR® X-series polymers, such as X-6044, X-6059, and X-6028. Also useful are oxidized hydrocarbons such as those available from Baker Petrolite Corp. as polyethylene-based oxidized materials and microcrystalline-based oxidized materials, such as the CARDIS® and PETRONAUBA® materials.

The third category (c) compounds include any suitable wax that will form a hydrophobic coating. Thus, animal, vegetable, mineral and synthetic waxes may be employed, as may be mixtures thereof.

Generally speaking, a wax is a substance that is a solid at ambient temperature and that has a low viscosity at just above its melting point. Typically, a wax is a substance having the following properties: (1) crystalline to microcrystalline structure, (2) capacity to acquire gloss when rubbed (as distinct from greases), (3) capacity to produce pastes or gels with suitable solvents or when mixed with other waxes, (4) low viscosity at just above the melting point. See *Grant & Hackh's Chemical Dictionary* ($5^{th}$ Edition), page 628, hereby incorporated by reference. Waxes differ from fats in that fats are esters of trihydric lower alcohols.

One preferred additional wax is the fully saturated homopolymer of a low molecular weight polyethylene (such as a low molecular weight polyolefin), or copolymers of various alkene monomers that form polymers with a molecular weight at or below 3,000, a melting point below 130° C., and low melt viscosities. Applicable waxes could include POLYWAX® that is available from Baker Petrolite Corp. Another preferred wax is carnauba wax available as a dispersion from Elementis Specialties (Hightstown, N.J.) under the name SLIP-AYD® SL 508.

POLYWAX® is a linear polyethylene wax. A particularly preferred wax is POLYWAX® 400, CAS [9002-88-4], described as polyethylene homopolymer with weight average molecular weight of about 450 and a melting point of 81° C. (177.8° F.). Additional information on this material can be found at the website for POLYWAX® 400:

<http://www.bakerhughes.com/bakerpetrolite/polymers/ethylene_homopolymers.htm>.

In preferred embodiments, component (c) is a microcrystalline wax, carnauba wax, petronauba wax, paraffin wax, candelilla wax, or a linear low molecular weight polyethylene wax.

Silicone oils useful in category (d) include poly(diphenylphenylmethylsiloxane), poly(diphenylsiloxane), poly(methylethylsiloxane), poly(methylbutylsiloxane), poly(methylhexylsiloxane), and polydimethylsiloxane. Silicone oils can also possess a variety of terminating groups, including trimethylsilyl, distearate, perfluorooctadecyl, and aminopropyl. Particularly preferred silicone oils are aminopropyl terminated poly(dimethylsiloxane)s that are available from Gelest, Inc. (Morrisville, Pa.).

The total amount of lubricants in the protective layer is generally of from about 0.01 to about 1.5 $g/m^2$ and preferably from about 0.1 to about 0.5 $g/m^2$.

One or more binders may also be used in the protective layer. In preferred embodiments, polymeric thermoplastic binders are employed. Examples of such materials include but are not limited to, poly(styrene/acrylonitrile) (for example a 70/30 monomer weight ratio), polyvinyl butyral (available commercially as BUTVAR® B-79 or S-LEC® BL5Z or MOWITAL® SB45H), polyvinyl benzal, polystyrene, poly(vinyl acetate), cellulose acetate butyrate (available commercially as CAB 171-15), cellulose acetate propionate, cellulose acetate, ethyl cellulose, cellulose triacetate, poly(methyl methacrylate), and copolymers derived from methyl methacrylate. In preferred embodiments of the invention, the binder is CAB 171-15.

The amount of the binder(s) present in the protective layer is generally in an amount of from about 50 to about 95 weight % of the total protective layer.

The protective layer can also contain matting agents such as particles of starch, titanium dioxide, zinc oxide, silica, calcium carbonate, and polymeric beads including beads of the type described in U.S. Pat. No. 2,992,101 (Jelley et al.) and U.S. Pat. No. 2,701,245 (Lynn). The matting agents can be composed of any useful material and may have an average size in relation to the protective layer thickness that enables at least some of them to protrude through the outer surface of the protective layer, as described for example, in U.S. Pat. No. 5,536,696 (noted above). If matting agents are present, they generally comprise from about 0.2 to about 10 dry weight % of the protective layer. It may be desirable that the outermost protective layer that is in contact with thermal imaging means has a dynamic coefficient of friction less than 0.3 as described in U.S. Pat. No. 5,817,598 (noted above), incorporated herein by reference for the measurement of coefficient of friction. This may be accomplished with an appropriate use of lubricants and matting agents as one skilled in the art would readily understand.

In particular, the outermost layers are generally formulated with one or more hydrophobic binders such as cellulose ester polymer binders. Of these binders, cellulose nitrate, cellulose acetate, cellulose acetate butyrate, and cellulose acetate propionate are preferred.

If desired, the protective layers can include one or more polyisocyanate crosslinking agents to "harden" the layer(s). Useful polyisocyanate crosslinking agents are described for example in U.S. Pat. No. 6,313,065 (noted above), U.S. Pat. No. 5,275,932 (noted above), and U.S. Pat. No. 5,578,548 (noted above), all incorporated herein by reference. Various catalysts such as tertiary amines can be used in combination with the polyisocyanates.

Polymeric fluorinated surfactants may also be useful in the protective layer as described in U.S. Pat. No. 5,468,603 (Kub).

In addition, nanometer size particles can be used as reinforcing agents in the protective layer. Such particles are described in for example, in U.S. Patent Application Publication 2004/0198602 (Pham) that is incorporated herein by reference.

In general, the outermost protective layer has a dry thickness of from about 0.1 to about 10 μm. Preferably the protective layer dry thickness is from about 1 to about 6 μm, and more preferably, it is from about 2 to about 5 μm.

Alternatively, and preferably, the direct thermographic materials have a dual protective layer comprising two non-thermally sensitive protective layers on at least the imaging side of the support. These two protective layers are in direct contact with each other. The outermost ("first") protective layer is farther from the support than the innermost ("second") protective layer. The first protective layer is preferably the outermost layer of the thermographic material but it does not need to be if a desirable "slip" layer is applied over it. However, since the first protective layer contains predominantly all of the lubricants and matte agents used to facilitate transport during imaging, it can serve as the "slip" layer. The second protective layer is substantially free of lubricants and matte agents meaning that none are purposely incorporated therein but some may migrate from overlying or underlying layers.

By locating the lubricants, matte agents, and other components desired to facilitate transport in the outermost (or "first") protective layer, less lubricant can be used and still achieve the desired "slip" properties. It is particularly desired that the outermost ("first") protective layer have a dynamic coefficient of friction of less than 0.3 when the thermographic material is moved in contact and relative to an imaging means such as a thermal print-head. This "slip" property is usually provided by incorporating one or more lubricants into the outermost protective layer. Mixtures of lubricants such as one or more solid lubricants and one or more liquid lubricants can be used. The dynamic coefficient of friction can be measured as described in U.S. Pat. No. 5,817,598 (noted above).

In duplitized thermographic materials, the same or different first and second protective layers can be disposed on both sides of the support as long as the first protective layer is farther from the support on both sides thereof and the second protective layer on both sides of the support is substantially free of lubricants and matte agents.

When present, matting agents are preferably located in the first protective layer.

In dual protective layer constructions, the first protective layer has a dry thickness of from about 0.1 to about 5 μm, preferably from about 0.3 to about 3 μm, and more preferably, from about 1 to about 2 μm. The second protective layer generally has a dry thickness of from about 0.1 to about 5 μm, preferably from about 0.5 to about 4 μm, and more preferably, from about 1 to about 3 μm. The ratio of dry thickness of the first protective layer to the second protective layer is generally from about 1:20 to about 3:1 and preferably from about 1:10 to about 2:1.

Additional details regarding direct thermographic materials having dual protective layers and their use can be found in copending and commonly assigned U.S. Ser. No. 11/166,309 (filed on even date herewith by Kenney, Baird, Kub, Ishida, and Ramsden, entitled "Direct Thermographic Materials with Dual Protective Layers") that is incorporated herein by reference.

Non-Light-Sensitive Adhesive Layer

The thermographic materials may include a non-light sensitive adhesive layer between the support and one or more thermographic layers on each side of the support that includes thermographic layers. This adhesion layer is often called a "primer" layer when applied to the support separately from the thermographic layer formulations, and is often called a "carrier" layer when applied simultaneously with (and "carries") the thermographic layer coating formulations onto the support. Simultaneous multilayer coating using carrier layers is preferred in high-speed manufacturing processes. For the remainder of this section, the term "carrier" layer will be used in reference to the non-light sensitive adhesive layer. In preferred embodiments, the carrier layer is the only layer between the support and the thermographic layers on either or both sides of the support. Thus, the carrier layer is directly disposed on the support without the use of additional primer or subbing layers and allows the support to be used in an "untreated" and "uncoated" form before the simultaneous application of the carrier layer with other layers.

The carrier layer comprises one or more polyisocyanate crosslinking agents dispersed within one or more hydrophobic crosslinkable polymer binders. Such crosslinking agents have at least two isocyanate groups that may or may not be blocked with groups that are readily displaced during the hardening or crosslinking action. Thus, by "polyisocyanate," we mean to include "polyisocyanate precursor compounds." The polyisocyanates can comprise aliphatic, cycloaliphatic, or aromatic groups, or a combination thereof. They are also intended to include "polymeric isocyanates" that are polymeric compounds having repeating isocyanate groups along the polymer backbone.

As used herein, "aromatic" polyisocyanates are intended to include compounds having the isocyanate group attached directly to a carbocyclic aromatic group, while "aliphatic" and "cycloaliphatic" polyisocyanates, while they may contain aromatic groups, have the isocyanate group attached only to a fully saturated carbon atom. The aromatic polyisocyanates are preferred in the practice of this invention.

More particularly, useful polyisocyanate crosslinking agents can be represented by the following Structure (I):

$$O{=}C{=}N{-}L{-}(N{=}C{=}O)_m \quad (I)$$

wherein L is a linking group, and m is an integer of at least 1 (preferably, 1, 2, or 3, and more preferably 1 or 2). Representative examples of L include substituted or unsubstituted alkylene groups having 6 to 18 carbon atoms in the chain, substituted or unsubstituted cycloalkylene groups having 6 to 18 carbon atoms in the ring, or substituted or unsubstituted arylene groups having 6-12 carbon atoms in one or more aromatic rings. L can also include any combination of one or more alkylene, cycloalkylene, or arylene groups that are separated by hetero linking groups such as oxy, carbonyl, thio, sulfonyl, sulfonamido, imino, and isocyanurate groups as long as such groups do not adversely affect the crosslinking function of the polyisocyanate (for example, cause crosslinking of the polyisocyanate with itself).

Representative polyisocyanate crosslinking agents include the following compounds (some with identified commercial Trade Names):

- Toluene (2,4 or 2,6)-diisocyanate and derivatives thereof (DESMODUR® L75, CB55N, and CB75N),
- Naphthalene 1,5-diisocyanate,
- 4,4'-Diisocyanatodiphenylmethane (DESMODUR® VL),
- 3,3'-Dimethylbiphenyl-4,4'diisocyanate,
- p-Phenylene diisocyanate,
- Triphenylmethane triisocyanate,
- Tris-(4-isocyanatophenyl)thiophosphate (DESMODUR RFE),
- 3,3'-Dimethoxy-4,4'-biphenyl diisocyanate Polyisocyanurate of toluene diisocyanate (DESMODUR® RN),
- Hexamethylene diisocyanate and derivatives thereof (such as biuret derivatives and isocyanurate trimers) such as DESMODUR® N-100, N75, N-3000, and N-3300,
- m-Xylylene diisocyanate,
- Isophorone diisocyanate (DESMODUR I), and Cyclohexyl diisocyanate,
- 4,4'-Dicyclohexylmethane diisocyanate (DESMODUR® W),
- Trimethyl-hexamethylene diisocyanate, and mixtures thereof.

Preferred isocyanates are aromatic isocyanates and include toluene (2,4 or 2,6)-diisocyanate and derivatives thereof, naphthalene 1,5-diisocyanate, 4,4'-diisocyanatodiphenylmethane, p-phenylene diisocyanate, triphenylmethane triisocyanate, tris-(4-isocyanatophenyl)thiophosphate, 3,3'-dimethyl-4,4'-biphenyl diisocyanate, and 3,3'-dimethoxy-4,4'-biphenyl diisocyanate. The most preferred polyisocyanates include toluene (2,4 or 2,6)-diisocyanate and derivatives thereof such as DESMODUR® L75, DESMODUR® CB55N, and DESMODUR® CB75N. The most preferred polyisocyanates include DESMODUR® L75, DESMODUR® CB55N, and DESMODUR® CB75N.

The polyisocyanate crosslinking agent is generally present in an amount of at least 10%, and preferably from about 10 to about 75%, based on the dry weight of the hydrophobic crosslinkable polymer binders. The choice and amount of polyisocyanate is dependent upon the type and coverage of crosslinkable polymer binders in the carrier layer as well as the rate of hardening desired.

To enhance crosslinking of the polymer binders, the carrier layer may also include one or more "catalysts" that are known to accelerate the rate of reaction. Such compounds include, but are not limited to, tertiary amines such as DESMORAPID® PP and diazabicyclooctane (DABCO) and transition metal catalysts such as dibutyltin laurate, bismuth neodecanoate and zinc octanoate. Such catalysts can be present in an amount of at least 0.004 g/g of polyisocyanate, and preferably from about 0.001 to about 0.01 g/g of polyisocyanate.

The hydrophobic crosslinkable binders in the carrier layer are water-insoluble polymers that have active moieties that will react with an isocyanate group. Such reactive moieties include substituents with reactive hydrogen atoms, such as hydroxy groups, thiol groups, carboxy groups, amino groups, amido groups, and other groups readily apparent to one skilled in polymer chemistry. Examples of useful hydrophobic crosslinkable polymer binders include, but are not limited to, polyvinyl acetal resins (such as polyvinyl acetal and polyvinyl butyral), cellulosic polymers, polyesters, polycarbonates, epoxy resins, rosin polymers, polyketone resins, vinyl polymers, maleic anhydride ester copolymers. Such polymers can be obtained from several commercial sources or prepared using known starting materials and reaction conditions.

Preferably, the carrier layer comprises a single-phase mixture of two or more different polymers that include a "first" polymer serving to promote adhesion of the carrier layer to the polymeric support, and a "second" polymer. In such embodiments, the first polymer can be a polyvinyl acetal, cellulosic polymer, polyester, polycarbonate, epoxy resin, rosin polymer, polyketone resin, vinyl polymer, or maleic anhydride ester copolymer, and the second polymer can be a polyvinyl acetal resin, cellulosic resin, vinyl polymer, or maleic anhydride-ester copolymer. More preferably, the first polymer is a polyester and the second polymer is a polyvinyl acetal such as polyvinyl butyral), or a cellulosic polymer (such as cellulose acetate butyrate).

It is also desirable that the second polymer be compatible with the film-forming polymer binder(s) of the one or more thermographic layers. For example, the thermographic layers and the carrier layer independently can contain at least one polyvinyl acetal or cellulosic polymer binder.

Representative "second" polymers include polyvinyl acetals, cellulosic polymers, vinyl polymers (as defined above for the "first" polymer), acrylate and methacrylate polymers, and maleic anhydride-ester copolymers. The most preferred "second" polymers are polyvinyl acetals (such as polyvinyl butyral) and cellulosic ester polymers (such as cellulose acetate, cellulose diacetate, cellulose triacetate, cellulose acetate propionate, hydroxymethyl cellulose, cellulose nitrate, and cellulose acetate butyrate). Polyvinyl butyral is a particularly preferred second polymer. Of course, mixtures of these second polymers can be used in the carrier layer. These second polymers are also soluble or dispersible in the organic solvents described above.

The weight ratio of "first" polymer to "second" polymer in the carrier layer is generally from about 1:9 to about 1:1, and preferably from about 2:8 to about 4:6. A most preferred polymer combination is of polyester and polyvinyl butyral having a weight ratio of about 3:7.

The carrier layer can also include other components such as dyes, and stabilizers in conventional amounts. If the thermographic material is duplitized, the non-light sensitive adhesive layer can have the same or different composition and thickness on both sides of the support.

The carrier layer is generally coated out of one or more miscible organic solvents including, but not limited to, methyl ethyl ketone (2-butanone, MEK), acetone, toluene, tetrahydrofuran, ethyl acetate, ethanol, methanol, or any mixture of any two or more of these solvents. Further details about such coating techniques and compositions of "carrier" layer formulations are provided in U.S. Pat. No. 6,436,622 (Geisler), incorporated herein by reference.

The carrier layer generally has a dry thickness of from about 0.005 to about 5 μm, and preferably from about 0.1 to about 1 μm.

Additional details regarding polyisocyanate crosslinked carrier layers for thermographic materials can be found in copending and commonly assigned U.S. Ser. No. 11/166,291 (filed on even date herewith by Baird, Kenney, and Moose, entitled "Direct Thermographic Material with Crosslinked Carrier Layer,") that is incorporated herein by reference.

Thermographic Formulations and Constructions

An organic-based formulation for the thermographic emulsion layer(s) can be prepared by dissolving or dispersing the highly polymerized polyvinyl acetal binder, the source of non-photosensitive silver ions, the reducing agent, and other addenda in an organic solvent, such as toluene, 2-butanone (methyl ethyl ketone), acetone, methanol, or tetrahydrofuran (or mixtures thereof).

The direct thermographic materials can be constructed of two or more layers on the imaging side of the support. Two-layer materials would include a carrier layer and a single thermographic layer. The single thermographic layer would contain the non-photosensitive source of reducible silver ions, the reducing agent, the binder, as well as other optional materials such as toners, stabilizers, and other adjuvants.

Three-layer constructions can comprise a carrier layer, a thermographic layer, and a protective layer. Alternatively, three-layer constructions can comprise two thermographic layers containing desired components and a carrier layer.

Preferably the direct thermographic materials are four-layer constructions comprising a carrier layer, a thermographic layer, and dual protective layers.

The direct thermographic materials can contain plasticizers and lubricants such as poly(alcohols) and diols as described in U.S. Pat. No. 2,960,404 (Milton et al.), fatty acids or esters as described in U.S. Pat. No. 2,588,765 (Robijns) and U.S. Pat. No. 3,121,060 (Duane), and silicone resins as described in GB 955,061 (DuPont). The materials can also contain inorganic and organic matting agents as described in U.S. Pat. No. 2,992,101 (Jelley et al.) and U.S. Pat. No. 2,701,245 (Lynn). Polymeric fluorinated surfactants may also be useful in one or more layers as described in U.S. Pat. No. 5,468,603 (noted above).

Mottle and other surface anomalies can be reduced in the materials of this invention by incorporation of a fluorinated polymer as described in U.S. Pat. No. 5,532,121 (Yonkoski et al.) or by using particular drying techniques as described in U.S. Pat. No. 5,621,983 (Ludemann et al.).

Layers to reduce emissions from the film may also be present, including the polymeric barrier layers described in U.S. Pat. No. 6,352,819 (Kenney et al.), U.S. Pat. No. 6,352,820 (Bauer et al.), U.S. Pat. No. 6,420,102 (Bauer et al.), and U.S. Pat. No. 6,746,831 (Hunt), and in U.S. Pat. No. Application Publication 2004/0126719 (Geuens et al.), all incorporated herein by reference.

The direct thermographic materials may also usefully include a magnetic recording material as described in *Research Disclosure*, Item 34390, November 1992, or a transparent magnetic recording layer such as a layer containing magnetic particles on the underside of a transparent support as described in U.S. Pat. No. 4,302,523 (Audran et al.), incorporated herein by reference.

The direct thermographic materials can include one or more conductive or antistatic agents in any of the layers on either or both sides of the support. It is preferred that the conductive or antistatic layer be a non-light sensitive layer and be disposed on the backside of the support and especially where it is buried or underneath one or more other layers such as backside protective layer(s). Such backside layers typically have a water electrode resistivity (WER) of about $10^5$ to about $10^{12}$ ohm/sq. This technique is described in R. A. Elder *Resistivity Measurements on Buried Conductive Layers*, EOS/ESD Symposium Proceedings, Lake Buena Vista, Fla., 1990, pp. 251-254, [EOS/ESD stands for Electrical Overstress/Electrostatic Discharge].

Typical conductive or antistatic agents include metal oxides, soluble salts, evaporated metal layers, or ionic polymers as described in U.S. Pat. No. 2,861,056 (Minsk) and U.S. Pat. No. 3,206,312 (Sterman et al.), insoluble inorganic salts as described in U.S. Pat. No. 3,428,451 (Trevoy), polythiophenes as described in U.S. Pat. No. 5,747,412 (Leenders et al.), electroconductive underlayers as described in U.S. Pat. No. 5,310,640 (Markin et al.), electronically-conductive metal antimonate particles as described in U.S. Pat. No. 5,368,995 (Christian et al.), and electrically-conductive metal-containing particles dispersed in a polymeric binder as described in EP 0 678 776 A1 (Melpolder et al.).

The preferred non-light sensitive backside layer is a buried antistatic layer comprising metal oxide particles. Additional optional layers can also include an adhesion promoting layer, an antihalation layer, a layer containing a matting agent (such as silica), or a combination of such layers. Preferably, a single outermost protective layer disposed over the buried backside conductive layer performs several or all of the desired additional functions.

The preferred metal oxide particles are generally provided for formulation in inorganic colloidal or sol form in a suitable solvent such as water or a water-miscible solvent such as methanol or other low molecular weight alcohols. The inorganic metal oxide colloids include oxide colloids of zinc, magnesium, silicon, calcium, aluminum, strontium, barium, zirconium, titanium, manganese, iron, cobalt, nickel, tin, indium, molybdenum, or vanadium, or mixtures of these metal oxide colloids. The metal oxides can be doped with other metals such as aluminum, indium, niobium, tantalum or antimony. Tin oxides, antimony tin oxides, and metal antimonates are preferred.

Preferably, the buried backside conductive layer comprises non-acicular metal antimonate particles such as those described in U.S. Pat. No. 6,689,546 (LaBelle et al.), and in copending and commonly assigned U.S. Ser. No. 10/930,428 (filed Aug. 31, 2004 by Ludemann, LaBelle, Koestner, Hefley, Bhave, Geisler, and Philip) Ser. No. 10/930,438 (filed Aug. 31, 2004 by Ludemann, LaBelle, Philip, Koestner, and Bhave), Ser. No. 10/978,205 (filed Oct. 29, 2004 by Ludemann, LaBelle, Koestner, and Chen), Ser. No. 10/999,858 (filed Nov. 30, 2004 Ludemann, Koestner, LaBelle, and Philip), and Ser. No. 11/000,115 (filed Nov. 30, 2004 by Ludemann, LaBelle, Philip, and Geisler). All of the above patents and patent applications are incorporated herein by reference. Particularly useful backside conductive layers and their formulations are described in more detail below. Several conductive metal antimonates are commercially available from Nissan Chemical Industry, Ltd. (Japan) under the tradename CELNAX® 401M. The metal antimonate particles in the conductive layer are predominately (more than 50% by weight of total particles) in the form of non-acicular particles as opposed to "acicular" particles. By "non-acicular" particles is meant not needlelike, that is, not acicular. Preferably the metal antimonate is zinc antimonate ($ZnSb_2O_6$).

The conductive layer also includes one or more binder materials that are usually polymers that are generally soluble or dispersible in the organic solvents noted above. Polyvinyl acetals, polyesters, cellulosic ester polymers, and vinyl polymers such as polyvinyl acetate and polyvinyl chloride are particularly preferred, and the polyvinyl acetals, polyesters, and cellulosic ester polymers are more preferred. Blends of these various polymers can also be used to advantage in the conductive layer.

The conductive layer is generally coated out of one or more miscible organic solvents including, but not limited to, methyl ethyl ketone (2-butanone, MEK), acetone, toluene, tetrahydrofuran, ethyl acetate, ethanol, methanol, or any mixture of any two or more of these solvents. Alternatively, the conductive layer can be coated using aqueous solvents and hydrophilic binder or a polymer latex.

In addition to the conductive particles described above, other conductive materials may be present in a buried conductive backside layer or other backside layers. Such compositions include fluorochemicals that are described in U.S. Pat. No. 6,699,648 (Sakizadeh et al.) and U.S. Pat. No. 6,762,013 (Sakizadeh et al.). Both of these patents are incorporated herein by reference.

Layers to promote adhesion of one layer to another in thermographic materials are also known, as described in U.S. Pat. No. 5,891,610 (Bauer et al.), U.S. Pat. No. 5,804,365 (Bauer et al.), and U.S. Pat. No. 4,741,992 (Przezdziecki). Adhesion can also be promoted using specific polymeric adhesive materials as described in U.S. Pat. No. 5,928,857 (Geisler et al.).

Layer formulations described herein can be coated by various coating procedures including wire wound rod coating, dip coating, air knife coating, curtain coating, slide coating, or extrusion coating using hoppers of the type described in U.S. Pat. No. 2,681,294 (Beguin). The formulations can be coated one at a time and dried before application of another layer. Preferably, two or more formulations can be coated simultaneously by coating the multiple layers on top of a first applied layer while that layer is still wet using the same or different coating fluids or solvent mixtures using the procedures described in U.S. Pat. No. 2,761,791 (Russell), U.S. Pat. No. 4,001,024 (Dittman et al.), U.S. Pat. No. 4,569,863 (Keopke et al.), U.S. Pat. No. 5,340,613 (Hanzalik et al.), U.S. Pat. No. 5,405,740 (LaBelle), U.S. Pat. No. 5,415,993 (Hanzalik et al.), U.S. Pat. No. 5,525,376 (Leonard), U.S. Pat. No. 5,733,608 (Kessel et al.), U.S. Pat. No. 5,849,363 (Yapel et al.), U.S. Pat. No. 5,843,530 (Jerry et al.), and U.S. Pat. No. 5,861,195 (Bhave et al.), and GB 837,095 (Ilford). Simultaneous multiple layer slide coating is particularly preferred (for example, the non-photosensitive adhesion promoting carrier layer, the non-photosensitive thermographic imaging layer, and the one or more protective layers described above).

A typical wet coating thickness for the emulsion layer can be from about 10 to about 200 μm, and the layer can be dried in forced air at a temperature of from about 20° C. to about 100° C. The coated materials can be dried in forced air at a temperature of from about 20° C. to about 100° C. It is preferred that the thickness of the layer be selected to provide maximum image densities greater than about 0.2, and more preferably, from about 0.5 to 5.0 or more, as measured by an X-rite Model 361/V Densitometer equipped with 301 Visual Optics.

Imaging/Development

The direct thermographic materials can be imaged in any suitable manner consistent with the type of material using any suitable source of thermal energy. The image may be "written" simultaneously with development at a suitable temperature using a thermal stylus, a thermal print-head (including an array of thermal print-heads), or a laser, or by heating the material as it is moved while in contact with a heat absorbing material. The thermographic materials may include a dye (such as an IR-absorbing dye) to facilitate direct development by exposure to laser radiation. The dye converts absorbed radiation to heat. Thermal development is carried out with the materials being in a substantially water-free environment and without application of any solvent to the materials.

Preferably, the material is imaged using a thermal printer having an array of thermal print-heads. In such systems, the material is heated at from about 300 to 400° C. for less than 50 milliseconds (50 msec), often less than 20 msec and even for less than 10 msec to achieve a maximum density (Dmax) to silver coating weight ratio (that is silver efficiency) of at least 3.2 $m^2/g$.

Use as a Photomask

The direct thermographic materials are sufficiently transmissive in the range of from about 350 to about 450 nm in non-imaged areas to allow their use in a method where there is a subsequent exposure of an ultraviolet or short wavelength visible radiation sensitive imageable medium. For example, imaging and development of the materials affords a visible image. The thermographic materials absorb ultraviolet or short wavelength visible radiation in the areas where there is a visible image and transmit ultraviolet or short wavelength visible radiation where there is no visible image. The materials may then be used as a mask and positioned between a source of imaging radiation (such as an ultraviolet or short wavelength visible radiation energy source) and an imageable material that is sensitive to such imaging radiation, such as a photopolymer, diazo material, photoresist, or photosensitive printing plate. Exposing the imageable material to the imaging radiation through the visible image in the thermographic material provides an image in the imageable material. This method is particularly useful where the imageable medium comprises a printing plate and the thermographic material serves as an imagesetting film.

The following examples are provided to illustrate the practice of the present invention and the invention is not meant to be limited thereby.

Materials and Methods for the Experiments abd Examples

All materials used in the following examples can be prepared using known synthetic procedures or are available from standard commercial sources, such as Aldrich Chemical Co. (Milwaukee, Wis.), unless otherwise specified. All percentages are by weight unless otherwise indicated. The following additional materials were prepared and used.

Many of the chemical components used herein are provided as a solution. The term "active ingredient" means the amount or the percentage of the desired material contained in a sample. All amounts listed herein are the amount of active ingredient added unless otherwise specified.

ALBACAR® 5970 is a 1.9 μm precipitated calcium carbonate. It is available from Specialty Minerals, Inc. (Bethlehem, Pa.).

BUTVAR® B-79 is a polyvinyl butyral resin available from Solutia, Inc. (St. Louis, Mo.).

CAB 171-15 and 381-20 are cellulose acetate butyrate resins available from Eastman Chemical Co. (Kingsport, Tenn.).

CELNAX® CX-Z401M is a 40% organosol dispersion of non-acicular zinc antimonate particles in methanol. It was obtained from Nissan Chemical America Corporation (Houston, Tex.).

DESMODUR® CB 55N is a toluene diisocyanate available from Bayer Corporation (Pittsburgh, Pa.).

MEK is methyl ethyl ketone (or 2-butanone).

PARALOID® A-21 is an acrylic copolymer available from Rohm and Haas (Philadelphia, Pa.).

PIOLOFORM® BL-16 and LL-4140 are polyvinyl acetal resins available from Wacker Polymer Systems (Adrian, Mich.).

PS512 is an aminopropyldimethyl terminated polydimethylsiloxane available from United Chemical Technologies (Bristol, Pa.).

Sekisui S-LEC® BL resins are a family of low polymerization polyvinyl butyral resins. Sekisui S-LEC® BM resins are a family of medium polymerization polyvinyl butyral resins. Sekisui S-LEC® BH resins are a family of high polymerization polyvinyl butyral resins. All are prepared from polyvinyl alcohol and butryaldehyde and are available from Sekisui Chemical Company (Troy, Mich.).

Sekisui S-LEC® BX resins are a family of high polymerization polyvinyl acetal resins. Sekisui S-LEC® KS resins are a family of high Tg (glass transition temperature) resins. All are prepared from polyvinyl alcohol and acetaldehyde and are available from Sekisui Chemical Company (Troy, Mich.).

SYLOID® 74X6000 is a synthetic amorphous silica that is available from Grace-Davison (Columbia, Md.).

VITEL® PE 2700B, PE 5833B, and PE 7915 are copolyester resins and are available from Bostik, (Middleton, Mass.).

Color measurement such as L*, a*, and b* values were measured using a HunterLab UltraScan (Hunter Associates Laboratory, Inc., Reston, Va.). These values were determined using CIELAB standards described above.

EXAMPLE 1

Preparation and Coating of Backside Layers:

All thermographic materials had a buried backside conductive "carrier" layer and an outermost backside layer.

Buried Backside Conductive Carrier Layer Formulation:

A buried backside conductive carrier layer formulation was prepared by mixing the following materials:

| | |
|---|---|
| CELNAX ® CX-Z401M (containing 40% active solids) | 50.0 parts |
| MEK | 375 parts |
| VITEL ® PE 2700B LMW | 4.39 parts |
| CAB 381-20 | 17.5 parts |

Outermost Backside Layer Formulation:

An outermost backside layer formulation was prepared by mixing the following materials:

| | |
|---|---|
| MEK | 87.2 parts |
| CAB 381-20 | 11.0 parts |
| SYLOID ® 74X6000 | 0.14 parts |

The buried backside conductive layer formulation and outermost backside layer formulation were coated onto one side of a 7 mil (178 μm) blue tinted poly(ethylene terephthalate) support. A precision automated multilayer slide coater equipped with an in-line dryer was used. The backside coatings were dried at approximately 85° C. for 5 minutes. The coating weight of the backside conductive layer was 0.05 g/ft$^2$ (0.54 g/m$^2$) and that of the outermost backside layer was 0.4 g/ft$^2$ (4.3 g/m$^2$).

Preparation of Frontside Thermographic Coatings:

Frontside Primer Laver Formulation:

A solution containing 15 weight % of VITEL® 7915 in MEK was coated onto a 7 mil (178 μm) blue tinted polyethylene terephthalate support and dried in an oven at 85° C. for 4 minutes to form a primer layer for the thermographic image forming layer. The coating weight of the primer layer was 1.0 g/m$^2$.

Preparation of Frontside Protective Overcoat Formulation:

A frontside protective overcoat formulation having a viscosity of 530 cP (centipoise) was prepared by mixing the components shown below.

| Component | Amount |
|---|---|
| MEK | 62.77 parts |
| CAB 171-15 | 12.11 parts |
| PARALOID ® A-21 | 1.65 parts |
| PS512 | 0.39 parts in 2.17 parts of MEK |
| ALBACAR ® 5970 | 0.93 parts in 19.98 g of MEK |

Silver Soap Homogenate Formulation:

A silver soap thermographic homogenate formulation was prepared with the following components.

| Component | Amount |
|---|---|
| MEK | 75.5 parts |
| Silver Behenate | 24.0 parts |
| PIOLOFORM ® BL-16 | 0.5 parts |

The materials were mixed and homogenized by passing twice through a homogenizer at 5000 psi (352 Kg/cm$^2$). The materials were cooled between the two passes.

Thermographic Emulsion Formulation:

Thermographic emulsion layer formulations were prepared by mixing the components in TABLE I.

TABLE I

| Component | Amount (parts) | Mixing Time (Minutes) |
|---|---|---|
| Silver behenate homogenate (24%) | 104 parts | 15 |
| in MEK | 68.29-126.29 parts | |
| 4-Hydroxyphthalic acid | 1.68 parts | 60 |
| in Methanol | 12 parts | |
| 1(2H)-Phthalazinone | 4.8 parts | 30 |
| Binder Polymer (See TABLE II) | 62.3 parts | 60 |
| 2,3-Dihydroxybenzoic acid | 2.93 parts | 60 |
| Total | 256-390 parts | |

The viscosity of the emulsion was significantly affected by the degree of polymerization of the binder polymer used. Therefore the viscosity was adjusted by addition of various amounts of MEK to adjust the % solids of the thermographic emulsion formulation so that the resultant viscosity was appropriate for knife coating.

Preparation and Evaluation of Thermographic Materials:

Each of the thermographic emulsion formulations and protective overcoat formulation was dual-knife coated onto the primed 7 mil blue tinted polyethylene terephthalate support prepared above. A conventional, laboratory scale, dual-knife coater was used. Samples were dried in an oven at 185° F. (85° C.) for 7 minutes. The coating weight of the thermographic layer was approximately 15.3 g/m$^2$. The coating weight of the protective overcoat layer was approximately 3.0 g/m$^2$.

The thermographic materials were imaged on a custom-built thermographic printer to determine the Dmax above which fall-off occurred.

A sample of each material was transported to a 25 mm silicone rubber platen roller where it was nipped between the platen roller driven by a stepper motor and Kyocera 320 dot/in (12.6 dot/mm) thermal print-head at a maximum power of 0.095 W/dot. The back of the thermal print-head was attached to a fan-cooled heat sink. The front of the thermal print-head was in contact with the protective layer on the "frontside" of the sample with a force of 118 Newtons pushing it against the rubber roller.

The imaging electronics were activated causing the sample to be drawn between the print-head and roller. At the same time the resistive elements in the thermal print-head were pulsed across a line time of 6 millisecond. Duty cycle was set to produce a continuous tone wedge with an optical density of 0.01 OD units above base density of 0.16 at Dmin, 1.0 OD at mid density, and greater than 3.0 OD at high density as well as 8 and 21 step wedges. The voltage supplied to the print-head was approximately 14.5 Volts. This gave a maximum total energy of approximately 1.45 mJ/dot.

The sensitometric results, shown below in Table II demonstrate that binders with a higher degree of polymerization provide thermographic materials with higher Dmax and improved silver efficiency (defined as Dmax/silver coating weight). In addition, more highly polymerized polymers show less "fall-off" in image density and are capable of achieving higher Dmax.

Similar results would be obtained using similarly constructed direct thermographic materials having dual protective layers as described herein.

TABLE II

| Sample | Binder | Calculated MW | Degree of Polymerization | Dmax | Silver Coating Weight - (g/m$^2$) | Silver Efficiency | Fall-Off |
|---|---|---|---|---|---|---|---|
| | | Low and Medium Polymerization Polyvinyl Butyral: | | | | | |
| 1-1 | S-LEC ® BX-12Z | — | 300 | 3.11 | 0.99 | 3.14 | Fall-Off |
| 1-2 | PIOLOFORM ® BL-16 | — | 370 | 3.13 | 1.01 | 3.10 | Fall-Off |
| 1-3 | S-LEC ® BL-5Z | $3.2 \times 10^4$ | 500 | 3.16 | 1.04 | 3.04 | Fall-Off |
| 1-4 | BUTVAR ® B-79 | — | 600 | 3.33 | 1.03 | 3.23 | Fall-Off |
| 1-5 | S-LEC ® BM-1 | $4.0 \times 10^4$ | 650 | 3.33 | 0.99 | 3.36 | Fall-Off |
| 1-6 | S-LEC ® BM-S | $5.3 \times 10^4$ | 800 | 3.74 | 1.1 | 3.4 | No Fall-Off |
| | | High Polymerization Polyvinyl Butyral: | | | | | |
| 1-7 | S-LEC ® BH-S | $6.6 \times 10^4$ | 1000 | 3.41 | 1.05 | 3.24 | No Fall-Off |
| 1-8 | S-LEC ® BH-6 | $9.2 \times 10^4$ | 1450 | 3.46 | 0.92 | 3.76 | No Fall-Off |
| 1-9 | S-LEC ® BH-A | $11.5 \times 10^4$ | 1700 | 3.15 | 0.86 | 3.66 | No Fall-Off |
| 1-10 | S-LEC ® BX-3Z | $12.3 \times 10^4$ | 2000 | 3.81 | 1.06 | 3.59 | No Fall-Off |
| 1-11 | S-LEC ® BX-5Z | $13.0 \times 10^4$ | 2400 | 4.22 | 1.04 | 4.06 | No Fall-Off |
| | | Polyvinyl Acetals: | | | | | |
| 1-12 | S-LEC ® KS-10 | $1.7 \times 10^4$ | 300 | 2.92 | 0.98 | 2.98 | Fall-Off |
| 1-13 | S-LEC ® KS-1 | $2.7 \times 10^4$ | 550 | 3.45 | 1.13 | 3.05 | Fall-Off |
| 1-14 | S-LEC ® KS-3 | $10.8 \times 10^4$ | 2000 | 3.31 | 0.87 | 3.8 | No Fall-Off |
| 1-15 | S-LEC ® KS-5 | $13.0 \times 10^4$ | 2400 | 3.38 | 0.89 | 3.8 | No Fall-Off |

EXAMPLE 2

The following example demonstrates that increasing the degree of polymerization of the binder for non-photosensitive source of reducible silver by use of an isocyanate crosslinking agent increases silver efficiency and permits the use of lower polymerized polyvinyl acetals to prevent fall-off.

Thermographic materials were prepared, coated, and dried in the same manner as described in Example I except that the frontside primer layer formulation contained the following materials:

Control Samples 2-1-C, 2-3-C, and 2-5-C contained no isocyanate in the primer layer.

Samples 2-2-NI (non-inventive), 2-4-I, and 2-6-I contained isocyanate in the primer layer.

TABLE III

| Component | Amount | Amount |
|---|---|---|
| MEK | 86.04 parts | 86.04 parts |
| PIOLOFORM ® LL-4140 | 7.08 parts | 7.08 parts |
| VITEL ® PE 5833B | 2.52 parts | 2.52 parts |
| DESMODUR ® CB 55N | None | 4.36 parts |

Evaluation of Thermographic Materials:

The resulting thermographic materials were imaged with a thermal printer and using the same test pattern as described above. Image densities were again measured with an X-Rite Model 361/V densitometer.

The sensitometric results, shown below in TABLE IV, demonstrate that the presence of isocyanate in the frontside primer layer increased Dmax and improved the silver efficiency when compared with thermographic materials not having an isocyanate added to the primer layer formulation.

The results also show the effect of isocyanate addition to the primer layer depends on the degree of polymerization of the binder polymer in the thermographic emulsion layer. Polymers whose degree of polymerization is about 500 or more demonstrate improved silver efficiency and show no fall-off on the sensitometric curve.

Similar results would be obtained using similarly constructed direct thermographic materials having dual protective layers as described herein.

TABLE IV

| Sample | Binder | Degree of Polymerization | Dmax | Silver Coating Weight - (g/m$^2$) | Silver Efficiency | Fall-Off |
|---|---|---|---|---|---|---|
| 2-1-C | PIOLOFORM ® BL-16 | 370 | 3.13 | 1.01 | 3.1 | Yes |
| 2-2-NI | PIOLOFORM ® BL-16 | 370 | 3.51 | 1.03 | 3.4 | Yes |
| 2-3-C | S-LEC ® BL-5Z | 500 | 3.16 | 1.04 | 3.04 | Yes |
| 2-4-I | S-LEC ® BL-5Z | 500 | 3.81 | 0.99 | 3.85 | No |
| 2-5-C | BUTVAR ® B-79 | 600 | 3.33 | 1.03 | 3.23 | Yes |
| 2-6-I | BUTVAR ® B-79 | 600 | 4.27 | 1.01 | 4.23 | No |

EXAMPLE 3

The following example demonstrates that high molecular weight polyvinyl acetal binders having a glass transition temperature greater than about 100° C. are particularly effective in preventing both Dmax fall-off and in providing thermographic materials having strongly negative a* values.

Thermographic materials were prepared, coated, and dried in the same manner as described in Example 1 except that different polyvinyl acetal binders for the thermographic layer were evaluated. All thermographic layer contained 62.3 parts of the binders shown in TABLE V. Data in TABLE V were obtained from the suppliers' literature.

TABLE V

| | | Binder Polymers Evaluated | | | | | |
|---|---|---|---|---|---|---|---|
| Sample | Inventive or Comparative | Binder Polymer | Butyral (mol %) | Acetal (mol %) | Hydroxy (mol %) | Acetyl (mol %) | Tg (° C.) |
| 3-1-C | Comparative | Sekisui BX-12Z | — | 70 | 29 ± 3 | 3 maximum | 82 |
| 3-2-C | Comparative | Sekisui BL-5Z | 77 minimum | — | ~21 | 3 maximum | 62 |
| 3-3-C | Comparative | Butvar B-79 | 78 minimum | — | ~20 | 2.5 maximum | 62 |
| 3-4-C | Comparative | Sekisui BM-1 | 65 ± 3 | — | ~34 | 3 maximum | 67 |
| 3-5-C | Comparative | Sekisu BM-S | 73 ± 3 | — | ~22 | 3 maximum | 60 |
| 3-6-C | Comparative | Sekisu BH-S | 73 ± 3 | — | ~22 | 4–6 | 64 |
| 3-7-C | Comparative | Sekisui BH-6 | 69 ± 3 | — | ~34 | 3 maximum | 67 |
| 3-8-C | Comparative | Sekisui BH-A | 58 ± 3 | — | ~31 | 11–15 | 59 |
| 3-9-C | Comparative | Sekisui BX-3Z | — | ~66 | 33 ± 3 | 3 maximum | 87 |

TABLE V-continued

Binder Polymers Evaluated

| Sample | Inventive or Comparative | Binder Polymer | Butyral (mol %) | Acetal (mol %) | Hydroxy (mol %) | Acetyl (mol %) | Tg (° C.) |
|---|---|---|---|---|---|---|---|
| 3-10-C | Comparative | Sekisui BX-5Z | — | ~66 | 33 ± 3 | 3 maximum | 86 |
| 3-11-I | Inventive | Sekisui KS-10 | — | 74 ± 3 | ~25 | 3 maximum | 106 |
| 3-12-I | Inventive | Sekisui KS-1 | — | 74 ± 3 | ~25 | 3 maximum | 107 |
| 3-13-I | Inventive | Sekisui KS-3 | — | 74 ± 3 | ~25 | 3 maximum | 110 |
| 3-14-I | Inventive | Sekisui KS-5 | — | 74 ± 3 | ~25 | 3 maximum | 110 |

Evaluation of Thermographic Materials:

The resulting thermographic materials were imaged with a thermal printer and using the same test pattern as described above.

The initial CIELAB a* and b* values of the imaged samples were measured at an optical density of 1.2 were measured using a Hunter Lab UltraScan Colorimeter. As noted above, for thermographic materials it is desired that the a* and b* values be negative ("cold") and remain so after aging. The results, shown below in TABLE VI, demonstrate that inventive thermographic materials 3-11-I through 3-14-I incorporating a polymer binder having a glass transition temperature greater than about 87° C., preferably greater than about 100° C., and more preferably equal to or greater 106° C., provide lower a* values (that is, a more negative number) when compared with similarly prepared Comparative Samples 1-1-C through 1-10-C incorporating polymer binders having a lower glass transition temperature.

The results, shown below in TABLE VI demonstrate that that polyvinyl acetal resins having a glass transition temperatures greater than about 87° C. provide the lowest negative a* values. The results also show these resins also provide strongly negative b* values.

Similar results would be obtained using similarly constructed direct thermographic materials having dual protective layers as described herein.

TABLE VI

CIELAB Evaluation Imaged Materials

| Sample | Inventive or Comparative | Binder Polymer | a* at OD = 1.2 | b* at OD = 1.2 |
|---|---|---|---|---|
| 1-1-C | Comparative | Sekisui BX-12Z | −1.24 | −7.59 |
| 1-2-C | Comparative | Sekisui BL-5Z | −1.24 | −8.49 |
| 1-3-C | Comparative | Butvar B-79 | −1.35 | −8.42 |
| 1-4-C | Comparative | Sekisui BM-1 | −1.55 | −8.72 |
| 1-5-C | Comparative | Sekisu BM-S | −1.35 | −8.2 |
| 1-6-C | Comparative | Sekisu BH-S | −1.6 | −8.81 |
| 1-7-C | Comparative | Sekisui BH-6 | −1.5 | −0.03 |
| 1-8-C | Comparative | Sekisui BH-A | −1.29 | −9.11 |
| 1-9-C | Comparative | Sekisui BX-3Z | −1.33 | −9.03 |
| 1-10-C | Comparative | Sekisui BX-5Z | −1.22 | −8.94 |
| 1-11-I | Inventive | Sekisui KS-10 | −1.82 | −6.45 |
| 1-12-I | Inventive | Sekisui KS-1 | −2.14 | −8.48 |
| 1-13-I | Inventive | Sekisui KS-3 | −1.89 | −8.71 |
| 1-14-I | Inventive | Sekisui KS-5 | −1.98 | −8.85 |

The invention has been described in detail with particular reference to certain preferred embodiments thereof, but it will be understood that variations and modifications can be effected within the spirit and scope of the invention.

The invention claimed is:

1. A non-photosensitive direct thermographic material comprising a support and having thereon one or more thermographic layers, and said material further comprising a non-photosensitive source of reducible silver ions and a reducing agent for said reducible silver ions dispersed in a hydrophobic, organic solvent soluble binder, wherein at least one thermographic layer comprises a hydrophobic, organic soluble binder that is a polyvinyl acetal having a degree of polymerization greater than about 650 and less than about 2500.

2. The material of claim 1 wherein said polyvinyl acetal is polyvinyl butyral, polyvinyl acetal, or mixtures thereof.

3. The material of claim 1 wherein said polyvinyl acetal has a degree of polymerization of from greater than about 800 to about 2500.

4. The material of claim 1 wherein said one or more thermographic layers has been crosslinked by a polyisocyanate crosslinking agent.

5. The material of claim 1 that, upon imaging at between 300 and 400° C. for less than 20 milliseconds, provides an image Dmax to silver coating weight ratio of at least 3.2 $m^2/g$.

6. The material of claim 1 wherein said reducing agent and said non-photosensitive source of reducible silver ions are in a single thermographic layer.

7. The material of claim 1 wherein said non-photosensitive source of reducible silver ions includes one or more silver carboxylates, one of which is high crystalline silver behenate.

8. The material of claim 1 further comprising a non-thermally sensitive protective overcoat disposed on said one or more thermographic layers.

9. The material of claim 8 comprising dual protective overcoats wherein said outermost protective overcoat comprises matte particles and one or more lubricants.

10. The material of claim 1 further comprising a conductive layer on the backside of said support.

11. The material of claim 10 wherein said conductive layer is a buried layer and comprises non-acicular metal antimonate particles composed of $ZnSb_2O_6$.

12. The material of claim 1 further comprising one or more phthalazinone or phthalazinone derivatives in said one or more thermographic layers.

13. The material of claim 12 further comprising one or more hydroxyphthalic acids in said one or more thermographic layers.

14. The material of claim 1 that is a black-and white-direct thermographic material.

15. A method comprising imaging the direct thermographic material of claim 1 with a thermal imaging source to provide a visible image.

16. The method of claim 15 wherein said imaging is carried out using a thermal print-head when said thermographic material is moved in contact with and relative to said thermal print-head.

17. The method of claim 16 wherein said visible image is used for medical diagnostic purposes.

18. The method of claim 16 wherein said thermographic material has a non-thermally sensitive outermost protective layer disposed over said one or more thermographic layers that has a dynamic coefficient of friction of less than 0.3 when said material is moved in contact and relative to said thermal print-head.

19. A non-photosensitive black-and-white direct thermographic material comprising a support and having thereon one or more thermographic layers, said material further comprising a non-photosensitive source of reducible silver ions and a reducing agent for said reducible silver ions dispersed in a hydrophobic, organic solvent soluble binder, wherein at least one thermographic layer comprises a hydrophobic, organic soluble binder that is a polyvinyl acetal having a degree of polymerization about 500 or more and less than about 2500 that has been crosslinked by a polyisocyanate crosslinking agent.

20. The non-photosensitive direct thermographic material of claim 19 wherein the polyisocyanate is an aromatic polyisocyanate.

21. The non-photosensitive direct thermographic material of claim 19 wherein said polyvinyl acetal has a glass transition temperature greater than about 100° C.

* * * * *